US009440275B2

(12) United States Patent
Bruntink

(10) Patent No.: US 9,440,275 B2
(45) Date of Patent: Sep. 13, 2016

(54) SPRING MEANS FOR DEVICE FOR WORKING SHEET-LIKE MATERIAL

(71) Applicant: Nivora IP B.V., Lochem (NL)

(72) Inventor: Ronald Bruntink, Winterswijk (NL)

(73) Assignee: Nivora IP B.V., Lochem (NL)

( * ) Notice: Subject to any disclaimer, the term of this patent is extended or adjusted under 35 U.S.C. 154(b) by 0 days.

(21) Appl. No.: 14/433,834

(22) PCT Filed: Sep. 24, 2013

(86) PCT No.: PCT/EP2013/069852
§ 371 (c)(1),
(2) Date: Apr. 6, 2015

(87) PCT Pub. No.: WO2014/060195
PCT Pub. Date: Apr. 24, 2014

(65) Prior Publication Data

US 2015/0273555 A1 Oct. 1, 2015

(30) Foreign Application Priority Data

Oct. 18, 2012 (EP) ..... 12189147

(51) Int. Cl.

| | |
|---|---|
| ***B21D 31/00*** | (2006.01) |
| ***B21D 5/02*** | (2006.01) |
| ***B30B 15/00*** | (2006.01) |
| ***B30B 1/30*** | (2006.01) |
| ***B30B 15/16*** | (2006.01) |

(52) U.S. Cl.
CPC ..... *B21D 5/0272* (2013.01); *B21D 5/02* (2013.01); *B30B 1/30* (2013.01); *B30B 15/007* (2013.01); *B30B 15/163* (2013.01)

(58) Field of Classification Search
CPC ..... B21D 5/0272; B21D 5/029; B30B 1/30; B30B 15/007; B30B 15/163
USPC ..... 72/389.3
See application file for complete search history.

(56) References Cited

U.S. PATENT DOCUMENTS

| | | | | |
|---|---|---|---|---|
| 3,613,365 | A | 10/1971 | Costa | |
| 3,668,919 | A * | 6/1972 | Hongo | B21D 5/029 72/324 |
| 3,914,975 | A * | 10/1975 | Kawano | B21D 5/0272 100/258 A |
| 4,016,742 | A * | 4/1977 | Shiokawa | B30B 15/007 72/389.5 |
| 4,152,921 | A | 5/1979 | Dits | |
| 5,012,729 | A | 5/1991 | Slot | |
| 5,293,972 | A * | 3/1994 | Krumholz | B30B 15/007 188/371 |
| 6,401,512 | B1 * | 6/2002 | Gascoin | B21D 5/0272 72/389.4 |
| 7,013,698 | B2 * | 3/2006 | Arduino | B21D 5/0272 723/389.4 |

(Continued)

FOREIGN PATENT DOCUMENTS

| | | |
|---|---|---|
| EP | 0384529 A1 | 8/1990 |
| FR | 2674460 A1 | 10/1992 |

(Continued)

*Primary Examiner* — David B Jones
(74) *Attorney, Agent, or Firm* — The Webb Law Firm

(57) ABSTRACT

The invention relates to a device for working sheet-like material, such as a press brake for bending steel sheet. The device includes: a frame; two, relative to each other movable, substantially parallel beams for working the sheet-like material, which beams are connected to the frame; driving means for driving the substantially parallel beams away or towards each other; at least one spring means, connected at a horizontal position along said beams for urging the beams away from each other; wherein the spring means have a spring constant that is adjustable.

14 Claims, 4 Drawing Sheets

(56) References Cited

U.S. PATENT DOCUMENTS 8,459,089 B2 * 6/2013 Bruntink ..... B30B 1/30
100/267

FOREIGN PATENT DOCUMENTS

GB 1054388 1/1967
JP 2008155231 A 7/2008

* cited by examiner

SPRING MEANS FOR DEVICE FOR WORKING SHEET-LIKE MATERIAL

CROSS-REFERENCE TO RELATED APPLICATIONS

This application is the United States national phase of International Application No. PCT/EP2013/069852 filed Sep. 24, 2013, and claims priority to European Patent Application No. 12189147.7 filed Oct. 18, 2012, the disclosures of which are hereby incorporated in their entirety by reference.

BACKGROUND OF THE INVENTION

1. Field of the invention

The invention relates to a device for working sheet-like material, such as a press brake for bending steel sheet.

2. Description of Related Art

Press brakes used for working sheet-like materials are well known from the prior art. When the article to be bent is delivered with the center of the axis of the article to be bent at a position in the center of the beams (symmetric pressing), the pressure is equally distributed along the pressing axis of this article. When the article is delivered with the center of the axis of the article to be bent away from the center, an unequal distribution of pressure will result, with lower pressures towards the longitudinal ends of the pressing beams. The unequal distribution of pressure will cause the beams to become unstable and tilt. Delivery positions away from the center are often preferred for bending materials with a small surface (asymmetric pressing) because of the limited pressures exerted at the longitudinal ends of the beams.

Press brakes from the prior art are often employed with at least two separate sets of driving means in each movable beam, having the ability to turn off the pressure selectively, for instance by only applying pressure with the half of the upper beam to which the article is delivered. Still, in many cases, pressure is exerted asymmetrically relative to the position of the article, causing instability and tilting.

It is known to use spring means to urge the beams away of each other. The use of these spring means would reduce or prevent tilting in the case of asymmetric pressing, but would result in lowering the maximum pressure for folding and reducing the efficiency of the device in the case of symmetric pressing.

It is an object of the invention to reduce or even remove the above-mentioned disadvantages of the prior art.

SUMMARY OF THE INVENTION

This object of the invention is achieved by a device for working sheet-like material, which is characterized by said spring means having a spring constant that is adjustable.

By attaching at least one spring means with a spring constant that is adjustable, the spring pressure acting can be varied according to the process employed. In this way, the spring force can be increased while pressing asymmetrically, generating a counteracting force for preventing the beam from tilting. The spring force is reduced for symmetric pressing. This creates a stable device in the case of asymmetric pressing and maximum pressure and efficiency using the same device in the case of symmetric pressing.

In one embodiment the spring constant of at least one of the spring means is switchable between at least two predefined values, which allows for easy and economically competitive operation.

In a preferred embodiment, the spring means consists of a gas spring, having a chamber in fluid connection with a high pressure accumulator as well as having a fluid connection with a low pressure accumulator via a valve, such as a 2/2 solenoid valve. In this way, the characteristics of the gas spring can be switched: when said valve is open, gas will enter the low pressure accumulator and the spring constant will be low. When said valve is closed, gas is forced to enter the high pressure accumulator and the spring constant will be high.

In a more preferred embodiment, the spring means is connected between the longitudinal distal ends of the beams relative to the article to be bent. This allows for a maximum pressure applied with minimum spring force, and easy and safe operation as the spring means are fixed at a large distance apart from the bending process.

In yet another more preferred embodiment, two spring means are connected between both longitudinal ends of the beams. Apart from the advantages of the previous embodiment, this allows for maximum flexibility in the delivery location of articles to be bent as the counteracting force can be applied at both longitudinal ends of the beam.

In an even more preferred embodiment of the invention, one of the beams is fixed to the frame. Most brakes from the prior art are employed in such a way. This allows for easy operation of the device by people trained to use press brakes known from the prior art. Furthermore, a more competitive pricing is achieved, as the driving means are only arranged at the upper beam.

In an even more preferred embodiment of the invention, the pressure distribution along a substantial part of the longitudinal axis of the moving beam is substantially uniform. In this way, the device is able to exert pressures equal along the axis of the beam in the case of symmetric pressing, obtaining an article with a high-quality bend.

In a most preferred embodiment of the invention, the driving means comprise an electrically driven, belt and roller driven driving unit. Such a driving unit is for example known from European patent application No. 0 384 529.

BRIEF DESCRIPTION OF THE DRAWINGS

These and other advantages of the invention will be elucidated in conjunction with the accompanying drawings.

DETAILED DESCRIPTION OF THE INVENTION

Figure 1:
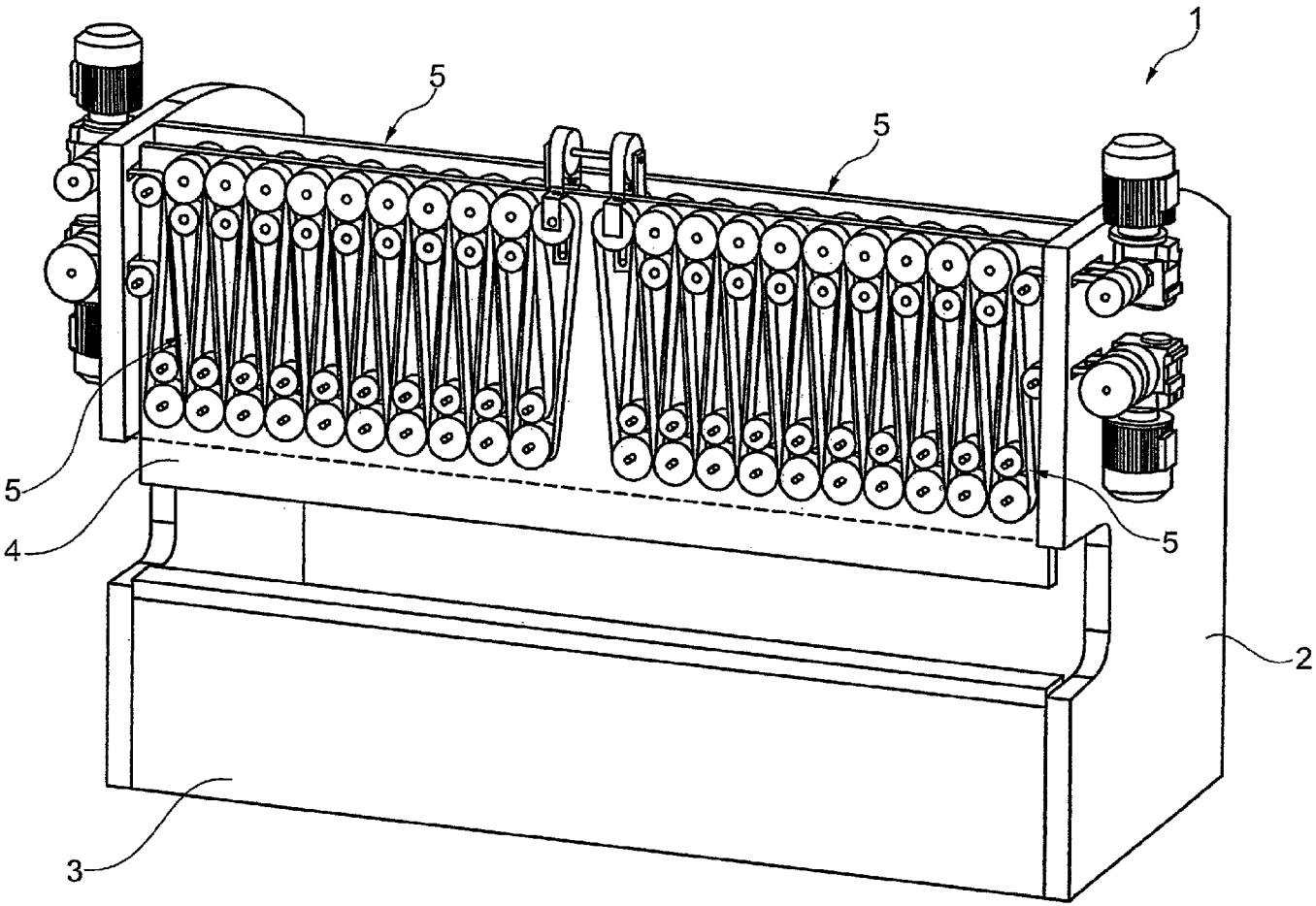
Fig.1 PRIOR ART
FIG. 1 shows a perspective view of an embodiment according to the prior art.

In FIG. 1 a press brake according to the prior art is shown. This device 1 comprises a so-called C-frame 2, with a lower beam 3 and an upper beam 4 arranged along their entire length at the frame. Near the upper beam 4, belt and roller driven driving means are arranged for moving upper beam 4 to and from the lower beam 3.

In FIG. 1, two belt and roller driving means 5 are arranged on the front side of the beam 4, while the other two driving means 5 are arranged on the back, whereas other types of arrangements of driving means 5 are also possible. In this case, lower beam 3 is fixed to C-frame 2, but it is also possible to have a device comprising beams with another configuration, such as, but not limited to a movable upper beam 4 and a movable lower beam 3, in which case both beams would comprise a driving means 5 arranged close to the respective beams.

Figure 2:
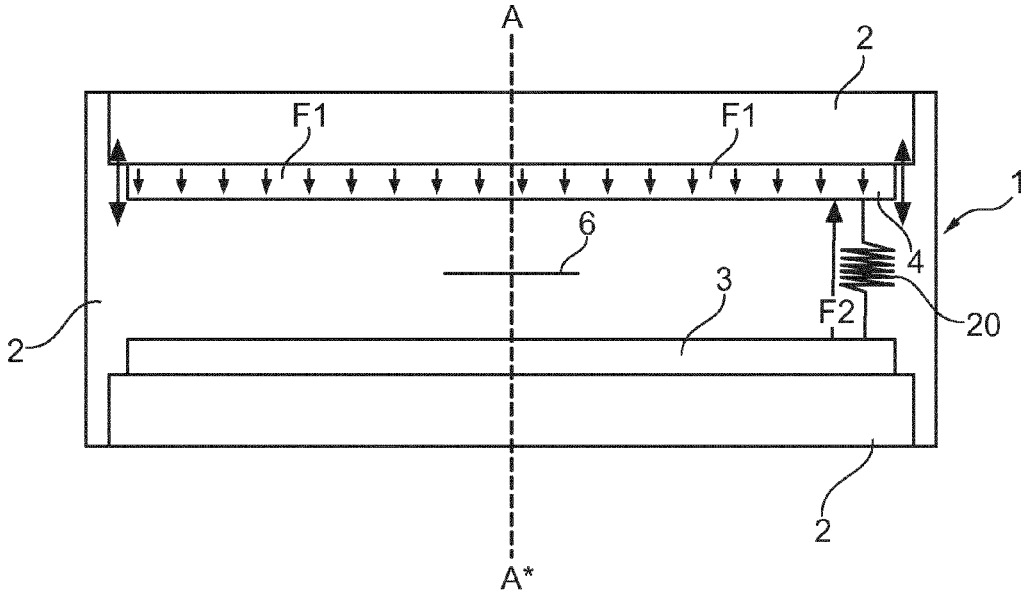
FIG. 2 shows a schematic front view of the embodiment according to FIG. 1 in the case of symmetric pressing.

The device according to FIG. 1 is shown schematically in FIG. 2. In this case, an article to be bent 6 is delivered with the center of the axis of the article 6 at the center of the longitudinal axis of the upper beam 4, A-A*. The next step involves decreasing the distance between upper beam 4 and lower beam 3 to press the article with forces F1 along the longitudinal axis of the beam (symmetric pressing). The forces are equally distributed along the longitudinal axis of the upper beam 4. The device comprises spring means 20 connected between a movable part of the device and a another part of the device, in this case upper beam 4 and lower beam 3 with a relatively low spring constant in order to urge upper beam 4 and lower beam 3 away from each other after pressing, by application of a force F2.

Figure 3:
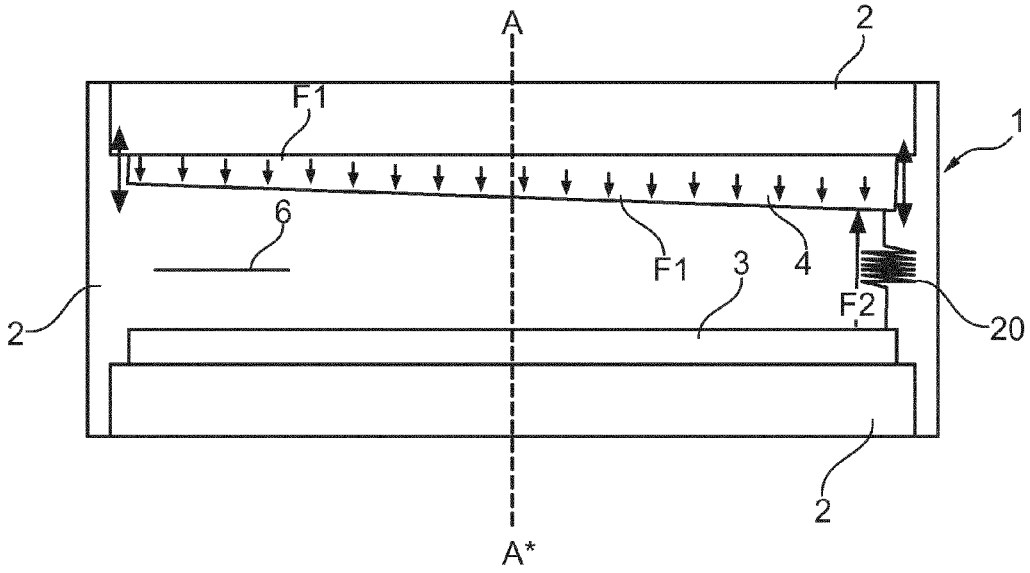
FIG. 3 shows a schematic front view of the embodiment according to FIG. 1 in the case of asymmetric pressing.

The same device is shown in FIG. 3, where the article to be bent 6 is delivered with the center of the axis of the article away from the center of the longitudinal axis of the beam upper beam 4, A-A*. When the distance between upper beam 4 and lower beam 3 is decreased and forces Fl are applied to article 6 (asymmetric pressing), the beam has a tendency to become unstable and tilt (as schematically shown). This instability is caused by the fact that the forces F1 applied by the upper beam 4 are applied asymmetrically, relative to the position of article 6, due to the delivery location with the center of the axis of article 6 away from the center of the longitudinal axis of upper beam 4, A-A*.

Spring means 20 that are used to urge upper beam 4 and lower beam 3 away from each other by application of force F2 could also be used to stabilize the movable beam, in this case upper beam 4. In order to apply sufficient pressure to stabilize said movable beam, the spring means 20 would need a high spring constant. This lowers however the maximum force applied by the press brake and thus lowering the efficiency in the case of symmetric pressing.

Figure 4:
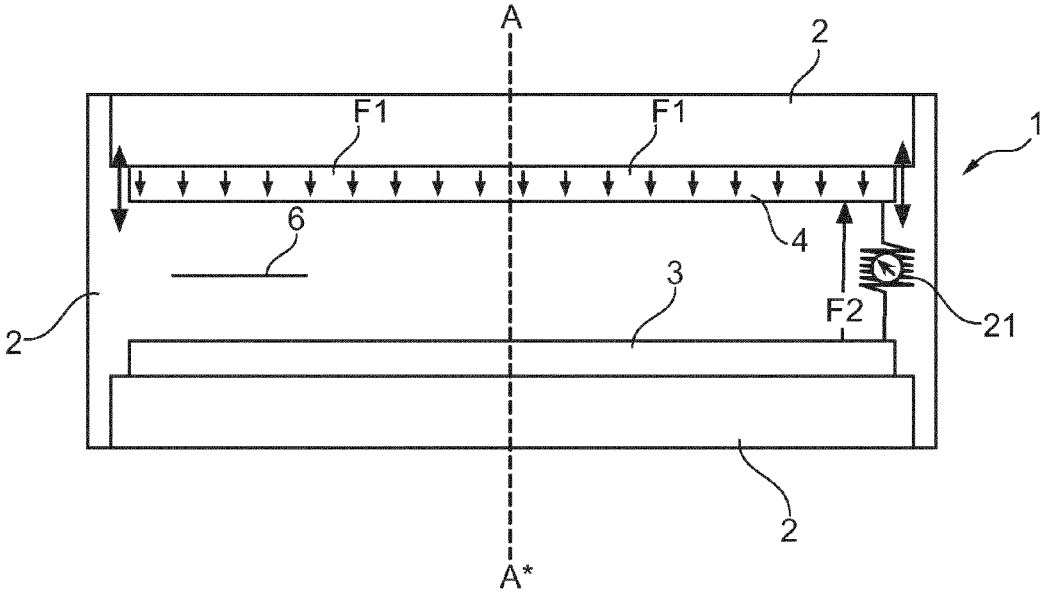
FIG. 4 shows a schematic front view of an embodiment according to the invention in the case of asymmetric pressing.

In FIG. 4, a press brake according to the invention is shown. Spring means 21, having a variable spring constant, are arranged at the one longitudinal end distal to the delivery position of article 6, fixed along upper beam 4 and lower beam 3. When the article to be bent 6 is delivered with the center of the axis of the article away from the center of the longitudinal axis of the beam, A-A*, and the distance between upper beam 4 and lower beam 3 is decreased, forces F1 are counteracted by a spring force F2, providing stability to the upper beam 4 and thereby preventing the beam from tilting.

The variable spring constant of spring means 21 is increased when the article is placed asymmetrically to be able to use higher pressure while reducing the risk on tilting. In case the article is placed symmetrically, the spring constant is reduced, such that the maximum pressure is subjected to the article.

Figure 5:
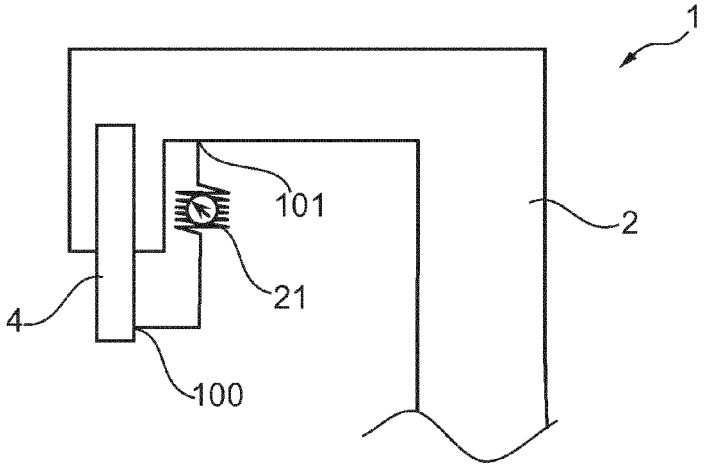
FIG. 5 shows a schematic side view of an embodiment according to the invention.

In this FIG. 4, the spring means are fixed to upper beam 4 and lower beam 3, whereas other arrangements are also possible, such as for instance, but not limited to, arrangements where spring means 21 are fixed to upper beam 4 and C-frame 2, or C-frame 2 and lower beam 3, also depending on which beams are movable. One such an arrangement is shown in FIG. 5, where one possible arrangement of spring means 21 between upper beam 4 and C-frame 2 with fixtures 100 and 101 is shown.

FIG. 4 shows a press brake with only one spring means 21, arranged at the one longitudinal distal end relative to the delivery position of article 6. Other arrangements are also possible, for instance arrangement of more than one spring means 21, at various positions along the axis of movable beams (in this case: upper beam 4) including arrangement of spring means 21 at both ends of the longitudinal axis of this beam.

In FIGS. 3 and 4, F1 is applied at the full length of the beam axis of the upper beam 4, while it is also possible to apply F1 to only a part of the beam axis, for instance by not using all driving means 5 arranged on the respective beam. This alone does not provide sufficient means for preventing the instability and tilting of the beam under most circumstances.

Figure 6:
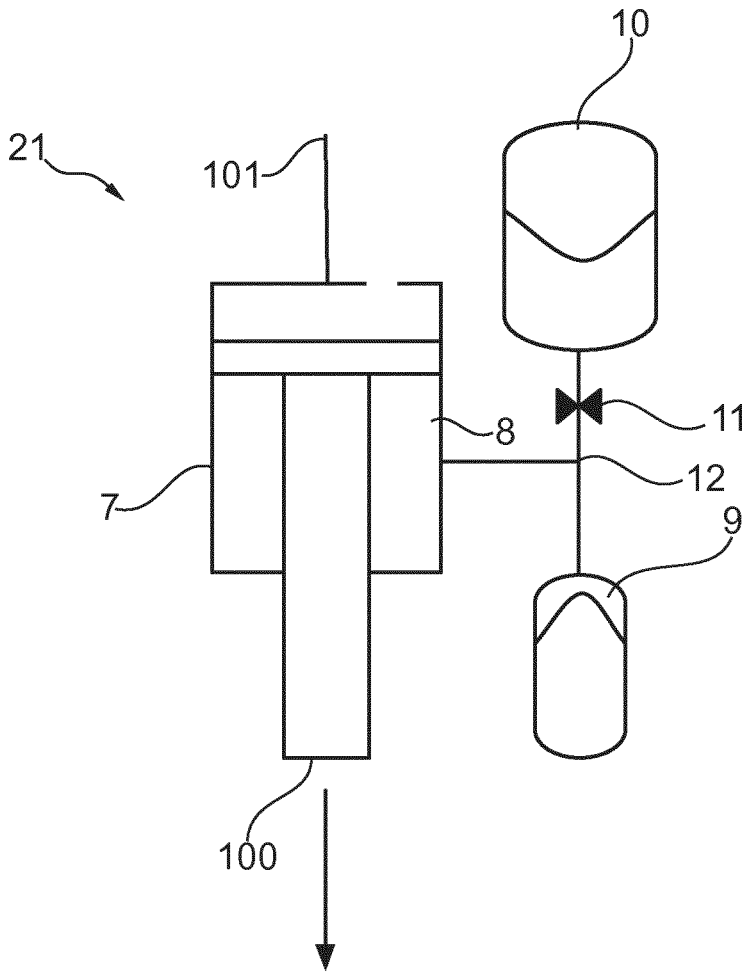
FIG. 6 shows a schematic front view of an embodiment of the gas spring according to the invention.

According to the invention, spring means 21 with an adjustable spring constant are used. One embodiment of such a spring is shown schematically in FIG. 6.

Spring means 21 consists of a cylinder 7 of which the chamber 8 is in fluid connection with both a high pressure accumulator 9 (directly) and a low pressure accumulator 10 via a valve 11, such as, but not limited to a 2-2 solenoid valve. In this case, the chamber is in fluid connection to both accumulators via a T-piece 12, but other arrangements are also possible.

Spring means 21 is designed in such a way that when valve 11 is open, and the cylinder 7 is under pressure, the gas will enter the low pressure accumulator 10. This is typically the case during the whole process of symmetric pressing and during asymmetric pressing when the beams are moved without pressing on the article.

When the pressing step starts during asymmetric pressing, valve 11 is closed to force the fluid from the cylinder 7 into the high pressure accumulator 9. This will increase the spring constant, such that a higher spring force is generated. This will stabilize the movable beam, thereby preventing the beam from tilting.

Spring means 21 is fixed with fixture 100 to a movable beam in the device, such as upper beam 4 in FIG. 4, whereas fixture 101 is fixed to another part of the device, such as, but not limited to C-frame 2 or lower beam 3, depending on with beams are movable.

The invention claimed is:

1. A device for working sheet-like material, which device comprises:

a frame;

two substantially parallel beams for working the sheet-like material, which beams are movable relative to each other and are connected along their entire length to said frame;

driving means for driving said substantially parallel beams away or towards each other; and at least one spring means, connected at a position along said beams for urging said beams away from each other;

wherein said spring means have a spring constant that is adjustable.

2. The device according to claim 1, wherein said spring means have a spring constant that is switchable between at least two predefined values.

3. The device according to claim 1, wherein said spring means comprises a gas spring.

4. The device according to claim 3, wherein said gas spring has a chamber in fluid connection with a high pressure accumulator and wherein said gas spring has said chamber in fluid connection with a low pressure accumulator via a valve.

5. The device according to claim 1, wherein said spring means is arranged along one longitudinal end of said beams.

6. The device according to claim 1, wherein spring means are arranged along either side of the longitudinal ends of said beams.

7. The device according to claim 1, wherein one of said beams is fixed to the frame.

8. The device according to claim 1, wherein the driving means provide a substantially uniform load on at least a part of a movable beam.

9. The device according to claim 8, wherein the driving means comprise an electrically driven, belt and roller driven driving unit.

10. The device according to claim 1, wherein the device is a press brake for bending steel sheet.

11. The device according to claim 4, wherein said gas spring has said chamber in fluid connection with a low pressure accumulator via a 2/2 solenoid valve.

12. A device for working sheet-like material, which device comprises:

a frame;

two substantially parallel beams for working the sheet-like material, which beams are movable relative to each other and are connected to said frame;

driving means for driving said substantially parallel beams away or towards each other; and at least one spring means, connected at a position along said beams for urging said beams away from each other;

wherein said spring means comprises a gas spring and has a spring constant that is adjustable; and wherein said gas spring has a chamber in fluid connection with a high pressure accumulator and wherein said gas spring has said chamber in fluid connection with a low pressure accumulator via a valve.

13. The device according to claim 12, wherein the device is a press brake for bending steel sheet.

14. The device according to claim 12, wherein said gas spring has said chamber in fluid connection with a low pressure accumulator via a 2/2 solenoid valve.

* * * * *